US009452316B2

(12) United States Patent
Wu

(10) Patent No.: US 9,452,316 B2
(45) Date of Patent: Sep. 27, 2016

(54) WHEEL CHAIR WITH LEG EXERCISING DEVICE

(71) Applicant: Kun-Yi Wu, Taitung (TW)

(72) Inventor: Kun-Yi Wu, Taitung (TW)

( * ) Notice: Subject to any disclaimer, the term of this patent is extended or adjusted under 35 U.S.C. 154(b) by 173 days.

(21) Appl. No.: 14/524,543

(22) Filed: Oct. 27, 2014

(65) Prior Publication Data

US 2015/0141212 A1 May 21, 2015

(30) Foreign Application Priority Data

Nov. 19, 2013 (TW) ..... 102221551 U

(51) Int. Cl.

*A63B 23/08* (2006.01)
*A63B 22/06* (2006.01)
*A61G 5/10* (2006.01)
(Continued)

(52) U.S. Cl.

CPC ..... *A63B 22/0605* (2013.01); *A61G 5/10* (2013.01); *A61G 5/12* (2013.01); *A61H 1/0214* (2013.01); *A63B 23/03516* (2013.01); *A63B 23/08* (2013.01); *A61G 5/026* (2013.01); *A61G 2005/1054* (2013.01); *A61G 2005/128* (2013.01); *A61H 1/0262* (2013.01); *A61H 2201/1253* (2013.01); *A61H 2203/0431* (2013.01); *A63B 2022/0652* (2013.01)

(58) Field of Classification Search

CPC ..... A63B 21/00043; A63B 21/00178; A63B 22/0605; A63B 22/0087; A63B 22/20; A63B 22/203; A63B 23/03516; A63B 23/04; A63B 23/0476; A63B 23/08; A63B 23/10; A63B 71/0009; A63B 2071/0018; A63B 2022/0652; A63B 2022/0617; A63B 2022/0033; A63B 2022/0038; A63B 2022/0094; A61G 5/003; A61G 5/026; A61G 5/028; A61G 5/1037; A61G 2005/128; A61H 1/02; A61H 1/0214; A61H 1/0237; A61H 1/024; A61H 1/0266; A61H 2001/0203; A61H 2203/0425; A61H 2203/0431; A61H 2205/10; A61H 2205/106; A61H 2205/12; A61H 2201/1253; A61H 2201/1261; A61H 2201/1269; A61H 2201/1276; A61H 2201/1418; A61H 2201/1436; A61H 2201/1445; A61H 2201/164; A61H 2201/1657; A61H 2201/1671; A61H 2201/1676; A61H 2201/1642; A61H 2201/50; A61H 2201/5023

USPC ..... 601/5, 23, 26, 27, 32–36, 49; 280/304.1

See application file for complete search history.

(56) References Cited

U.S. PATENT DOCUMENTS 4,274,651 A * 6/1981 Dumont ..... A61G 5/023 192/93 R
5,033,736 A * 7/1991 Hirschfeld ..... A61H 1/0214 482/57

(Continued)

*Primary Examiner* — Loan H Thanh
*Assistant Examiner* — Gregory Winter
(74) *Attorney, Agent, or Firm* — C. G. Mersereau; Nikolai & Mersereau, P.A.

(57) ABSTRACT

A wheel chair includes two pedals, two transmission devices, two clutch members and two control units. Each transmission device includes a driving unit, a clutch unit and a rear wheel driving unit. Each of the clutch units includes an intermediate disk and a clutch disk which is co-rotatably connected with the intermediate disk. Each of the rear wheel driving units is connected between the rear wheel and the intermediate disk. Each clutch device includes a shifter which controls the clutch disk to be disengaged from the intermediate disk. The control units each control the clutch disk to be engaged with the intermediate disk so as to connect the rear wheels with the force from the driving units so as to rotate the patient's legs counter clockwise.

12 Claims, 13 Drawing Sheets

(51) Int. Cl.

| | |
|---|---|
| ***A61G 5/12*** | (2006.01) |
| ***A63B 23/035*** | (2006.01) |
| ***A61H 1/02*** | (2006.01) |
| *A61G 5/02* | (2006.01) |

(56) References Cited

U.S. PATENT DOCUMENTS 5,242,179 A * 9/1993 Beddome ..... A61G 5/025 280/233
5,322,312 A * 6/1994 Cammack ..... A61G 5/025 280/11.115
6,142,914 A * 11/2000 Crawford ..... A61H 1/0214 280/304.1
7,886,854 B2 * 2/2011 Chiu ..... A61G 5/047 180/11
7,922,187 B2 * 4/2011 Fremgen ..... A61G 5/023 280/250.1
2008/0246246 A1 * 10/2008 Dix ..... A61G 5/023 280/233
2009/0020979 A1 * 1/2009 Genda ..... A61G 5/023 280/255
2011/0034302 A1 * 2/2011 Zlobinsky ..... A61B 5/0205 482/5
2013/0303340 A1 * 11/2013 Polishuk ..... A63B 22/04 482/80

* cited by examiner

WHEEL CHAIR WITH LEG EXERCISING DEVICE

BACKGROUND OF THE INVENTION (1) Fields of the Invention

The present invention relates to a wheel chair, and more particularly, to a wheel chair with two leg exercising devices providing exercising feature to the patient's legs.

(2) Descriptions of Related Art

The conventional wheel chair is designed for those who do not have strength of their legs and cannot walk by themselves. There are different types of wheel chairs available in the market and some are foldable and/or powered by batteries so as to provide convenient features to the patients or the assistants. However, the patient sitting in the wheel chair most feel boring, especially for those who cannot walk or lost their muscle strength of their legs. These patients need assistants to help them to put their feet on the footrests of the wheel chair, or to remove their feet from the footrests of the wheel chair many times daily. Some patients need to exerciser their legs regularly, and the exercises or rehabilitation are proceeded in hospitals or rehabilitation centers which may not be located close to the patients' houses. The rehabilitation equipment can also be purchased and do the rehabilitation actions at home, however, the rehabilitation equipment usually hulky and expensive. Besides, when the patients have assistants to help them to go outside, the patients cannot exercise their legs when sitting in the wheel chairs.

The present invention intends to provide a wheel chair which provides the patient to exercise their legs as to tread pedals of a bicycle such that the shortcomings mentioned above are eliminated.

SUMMARY OF THE INVENTION

The present invention relates to a wheel chair and comprises two front wheel frames and two rear wheel frames, two front wheels are connected to the two front wheel frames. Each front wheel frame has a front extension extending therefrom. Two rear wheels are connected to the two rear wheel frames. Two side frames are connected between the two front wheel frames and the two rear wheel frames. Two handles are connected to the two rear wheel frames.

Two pedals each have a connection unit on one side thereof. Two cranks each have a first end and a second end, the first end of each crank is connected to the connection unit corresponding thereto, and the second end of each crank is connected to the front extension corresponding thereto.

Two transmission devices are respectively connected to the two side frames and each transmission device has a driving unit, a clutch unit and a rear wheel driving unit. Each of the side frames is connected to the front wheel frame and connected to the second end of the crank. Each of the clutch units is located on outside of the front wheel frame and has an intermediate disk and a driving disk which is co-rotatably connected with the intermediate disk. Each of the rear wheel driving units are connected between the rear wheel and the intermediate disk.

Two clutch devices are respectively connected to the two front frames and each clutch device has a shifter which has a plate on the first end thereof, and the second end of the shifter is a fixed end. A middle portion of each of the shifters is pivotably connected to the front frame corresponding thereto.

Two control units are respectively connected to the handles and each control unit has a box in which a slide, a passive member and a hooked member are located. A button 55 is located on the surface of the box, and a push member 54 is connected to the box. The passive member is connected between the first end of the slide and a spring which is connected to the plate of the shifter. A second end of the slide is pivotably connected to the hooked member. The box has a restriction slot and the hooked member has an end removably located in the restriction slot. The button is pushed to pivot the hooked member to be removed from the restriction slot. The push member 54 has an end pivotably connected to the box and connected with the slide. The slide, the hooked member and the passive member are operated by pivoting the push member. The passive member is moved to activate the shifter to shift the clutch disk a distance to be engaged with the intermediate disk to connect the clutch unit and the driving unit. When the wheel chair moves, the rear wheels drive the rear wheel driving units such that patient's legs on the pedals are pivoted about the cranks counter clockwise.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
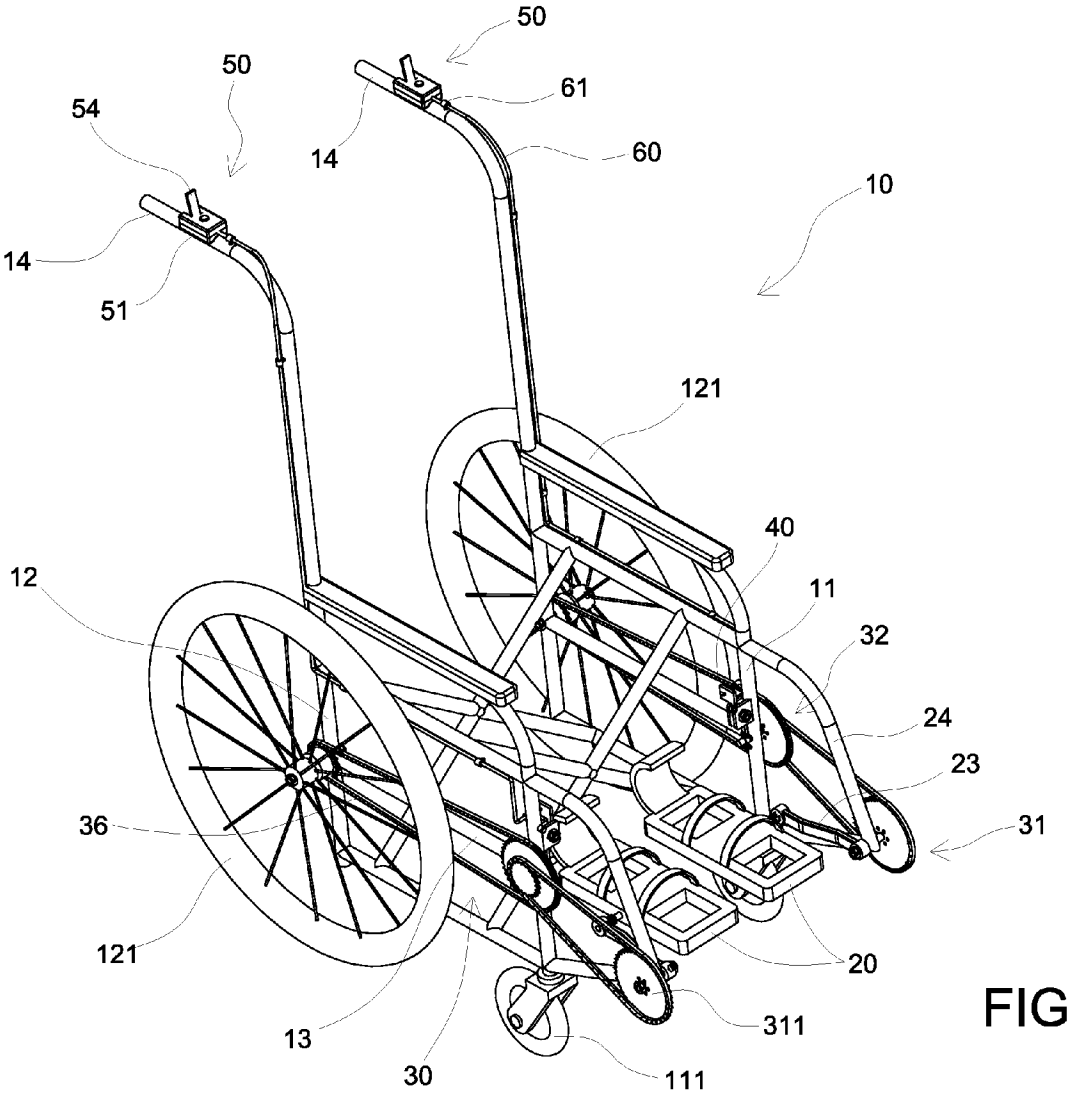
FIG. 1 is a perspective view to show the wheel chair of the present invention.
Figure 2:
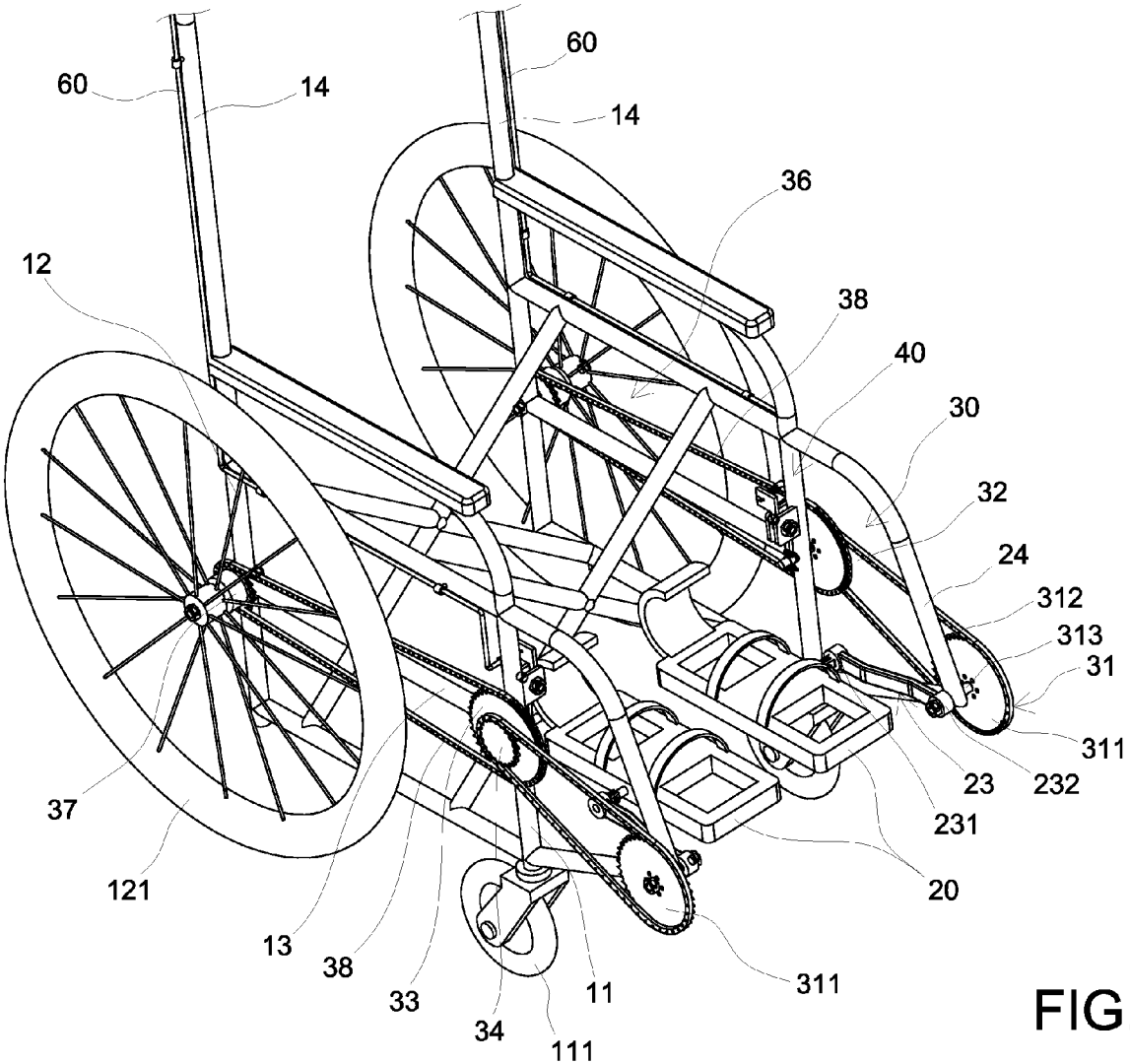
FIG. 2 is a perspective view to show a portion of the wheel chair of the present invention.

Referring to FIGS. 1 and 2, the wheel chair 10 of the present invention comprises two front wheel frames 11 and two rear wheel frames 12. Two front wheels 111 are connected to the two front wheel frames 11, and two rear wheels 121 are connected to the two rear wheel frames 12. Each front wheel frame 11 has a front extension 24 extending therefrom. Two side frames 13 are connected between the two front wheel frames 11 and the two rear wheel frames 12. Two L-shaped handles 14 are connected to the two rear wheel frames 12.

Figure 3:
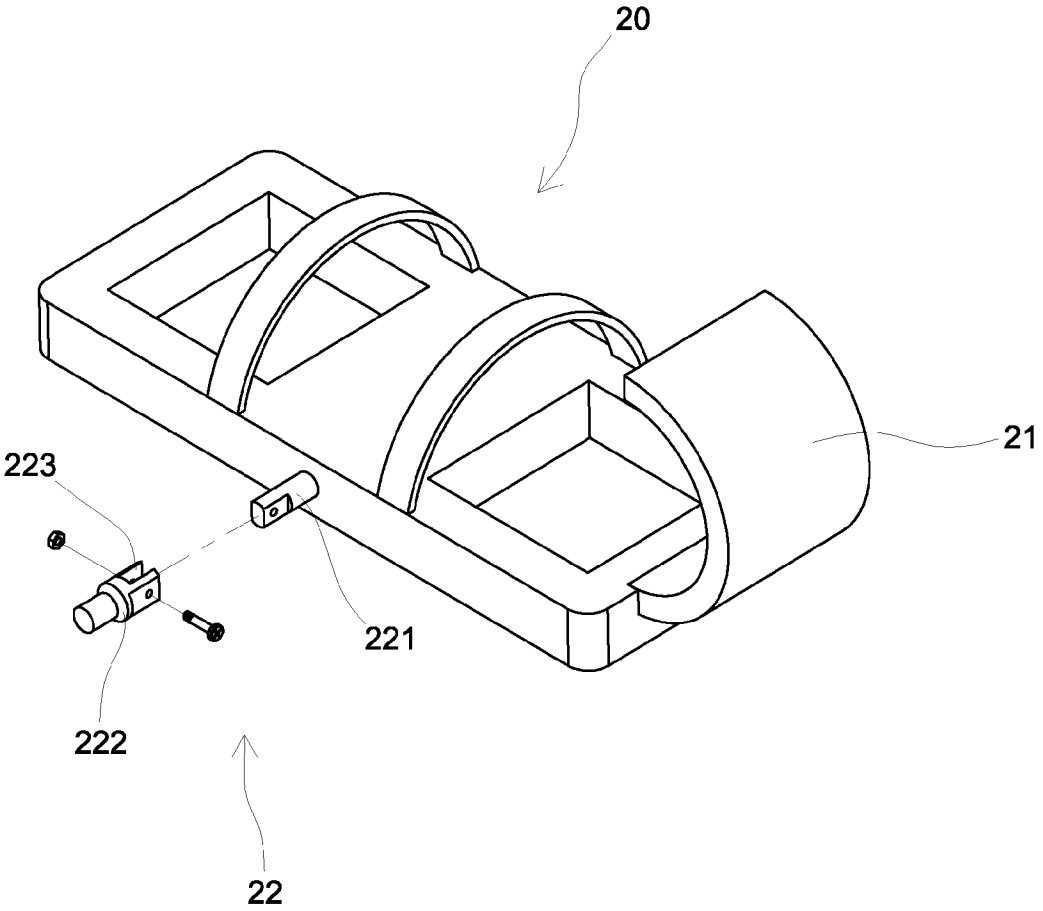
FIG. 3 shows the structure of the pedal of the wheel chair of the present invention.

The wheel chair 10 has two pedals 20 connected thereto and each pedal 20 has a connection unit 22 on one side thereof. Two cranks 23 each have a first end 231 and a second end 232, the first end 231 of each crank 23 is connected to the connection unit 22 corresponding thereto by way of threading, and the second end 232 of each crank 23 is connected to the front extension 24 corresponding thereto. As shown in FIG. 3, each of the pedals 20 has a curved stop 21 extending upward from the rear end thereof. Each of the connection units 22 has a protrusion 221 extending from the side of the pedal 20 and a pivoting member 222 is connected to the protrusion 221 at an angle. The pivoting member 222 has a slot 223 defined in the first end thereof. The protrusion 221 is inserted into the slot 223 and pivotably located connected to the pivoting member 222. The pedal 20 is pivoted about the protrusion 221 and toward the front wheel frame 11 so that the pedals 20 are able to be folded together with the folding action to the wheel chair 10. The second end of the pivoting member 222 is fixed to the first end 231 of the crank 23.

Two transmission devices 30 are respectively connected to the two side frames 13 and each transmission device 30 has a driving unit 31, a clutch unit 32 and a rear wheel driving unit 36. Each of the side frames 13 is connected to the front wheel frame 11 and connected to the second end 232 of the crank 23. Each of the driving units 31 has a driving disk 311 and a driving chain 312. The driving disk 311 is fixed to the second end 232 of the crank 23, and the driving chain 312 is connected between the driving disk 311 and the clutch disk 34. The driving disk 311 and a driving chain 312 can also be a gear and a belt. The driving disk 311 is cooperated with a shaft 313 which extends through a bearing (not shown) in the front extension 24. A nut is used to connect the second end 232 of the crank 23 to the shaft 313 on the other end of the driving disk 311 so that when the pedals 20 operated, the driving disks 311 are rotated.

Figure 4:
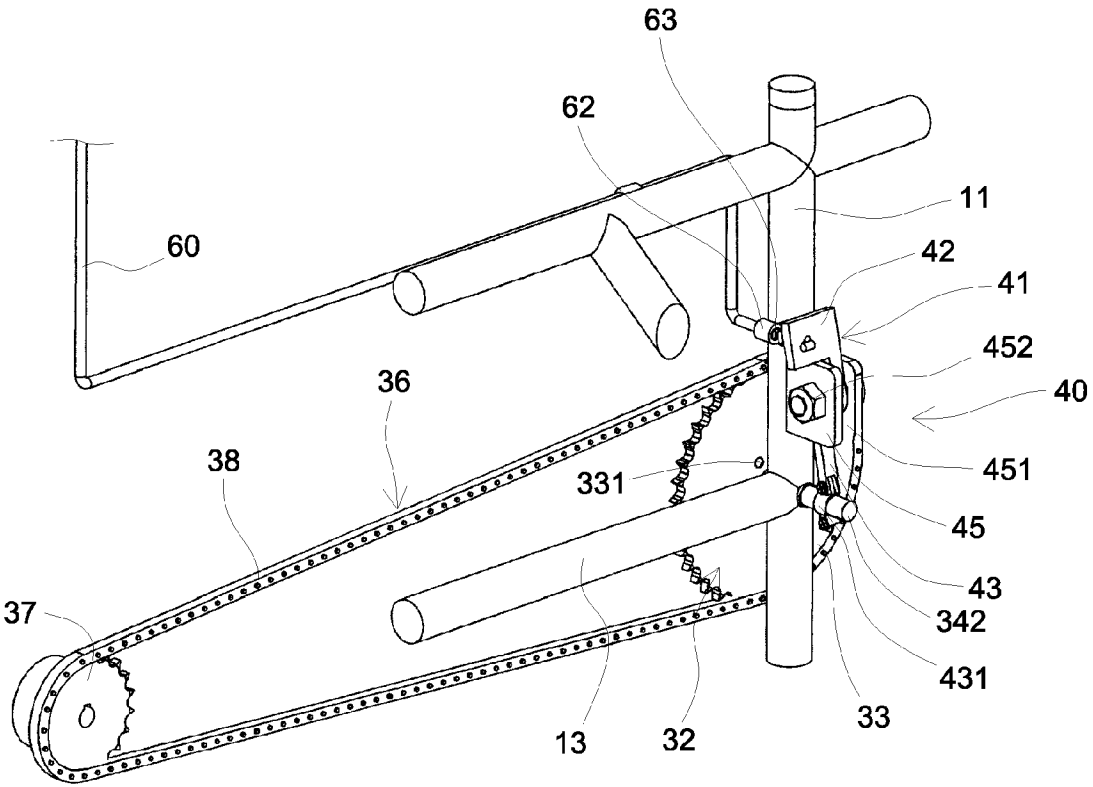
FIG. 4 shows the clutch unit and the clutch member of the wheel chair of the present invention.
Figure 5:
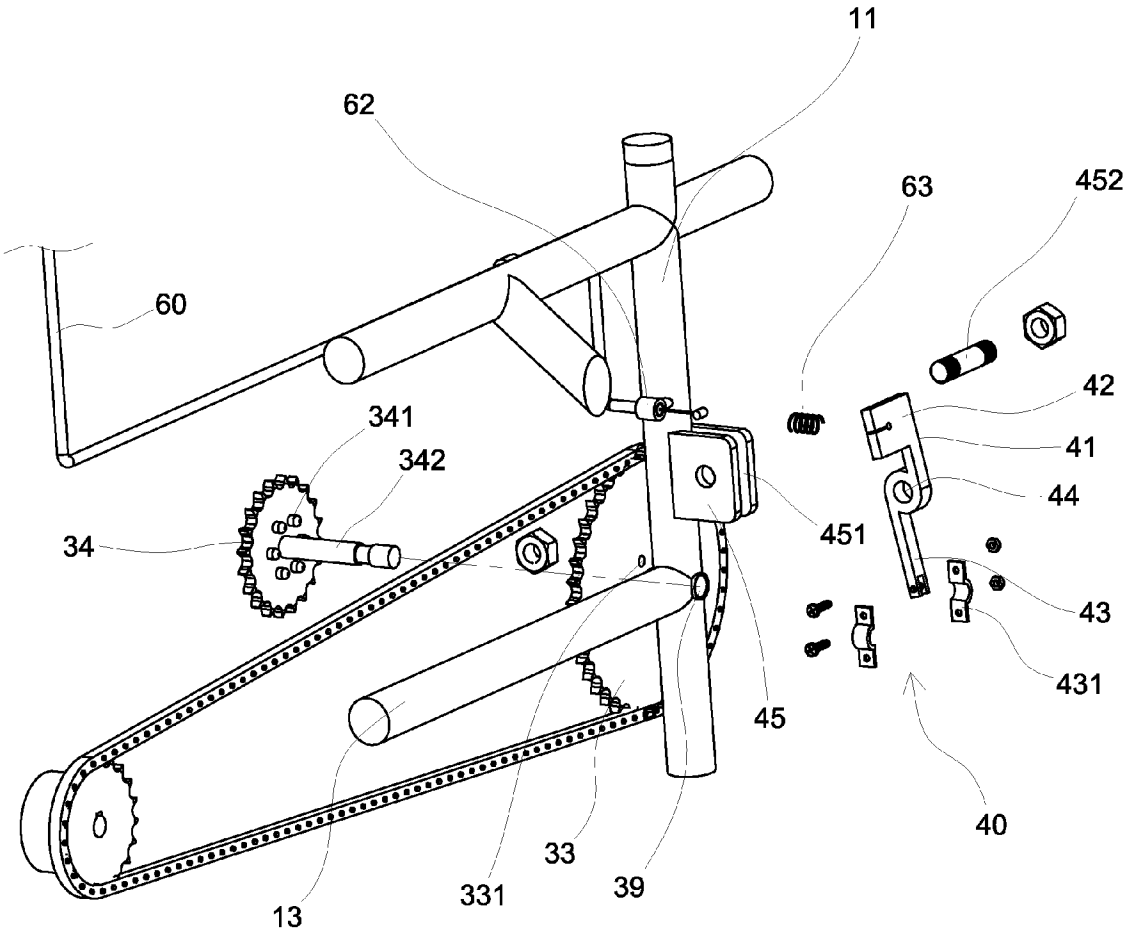
FIG. 5 is an exploded view to show the clutch unit and the clutch member of the wheel chair of the present invention.
Figure 6:
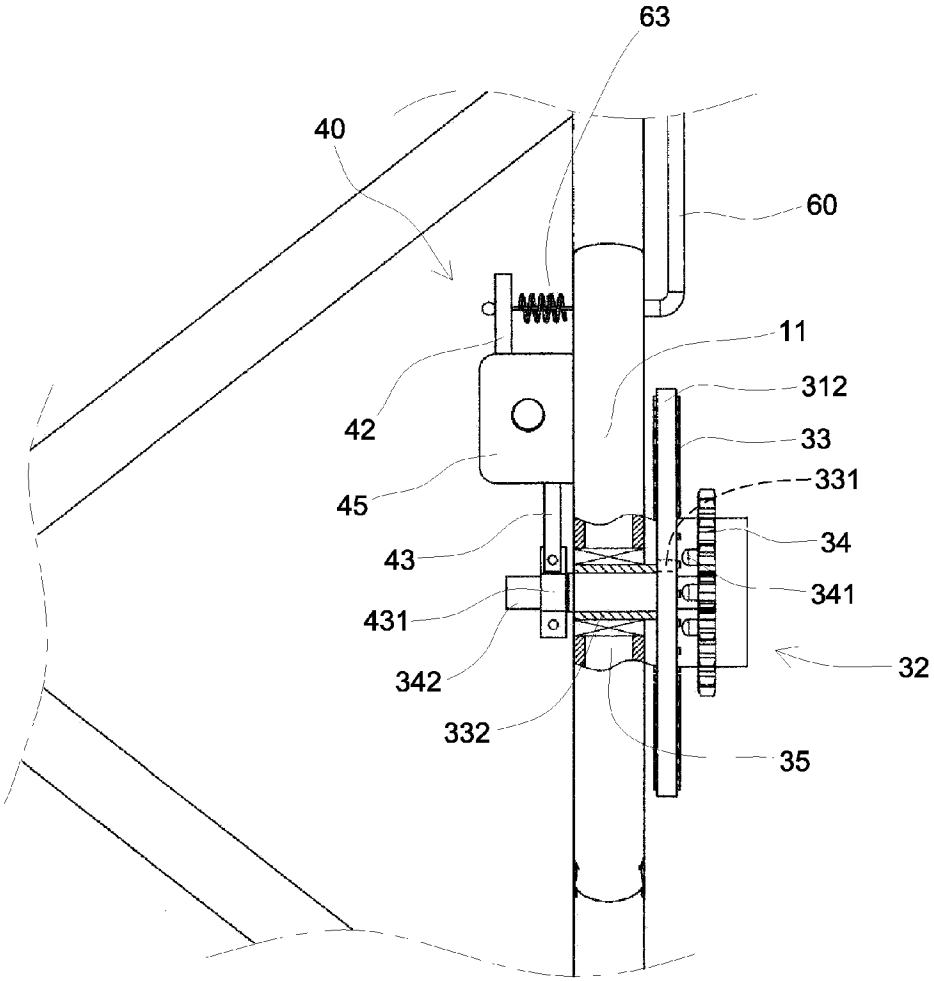
FIG. 6 is a cross sectional view of the clutch unit of the wheel chair of the present invention.

As shown in FIGS. 4 to 6, each of the clutch units 32 is located on outside of the front wheel frame 11 and has an intermediate disk 33 and a clutch disk 34 which is co-rotatably connected with the intermediate disk 33. The diameter of the intermediate disk 33 is larger than that of the driving disk 34. The number of teeth of the intermediate disk 33 is 3 to 4 times of the number of teeth of the clutch disk 34. The intermediate disk 33 has multiple first engaging portions 331 on one side thereof, and the clutch disk 34 has multiple second engaging portions 341 on one side thereof. The first engaging portions 331 are engaged with the second engaging portions 341. In this embodiment, the first engaging portions 331 of each of the intermediate disks 33 are holes and the second engaging portions 341 of each of the clutch disks 34 are studs. When the intermediate disk 33 is separated from the clutch disk 34, the intermediate disk 33 is rotated while the driving disk 34 is not co-rotated with the intermediate disk 33. The driving chain 312 is connected between the driving disk 311 and the clutch disk 34. Each of the intermediate disks 33 has a tube 332 extending from the center of one side thereof. Each of the front wheel frames 11 has a bearing 35 connected thereto. The tube 332 extends through the bearing 35. Each of the clutch disks 34 has a shaft 342 extending from the center of one side thereof. The shaft 342 extends through the tube 332 corresponding thereto so that the clutch disk 34 is located on outside of the intermediate disk 33. The intermediate disk 33 is rotatable about the bearing 35. The shaft 342 is fixed to the fixed end 43 of the shifter 41. The clutch disk 34 is located on the outside of the intermediate disk 33, and the shaft 342 is located at the inside of the front wheel frame 11.

Each of the rear wheel driving units 36 are connected between the rear wheel 121 and the intermediate disk 33. Each of the rear wheel driving units 36 has a rear wheel disk 37 which is co-axially connected to the rear wheel 121. A rear wheel chain 38 is connected between the rear wheel disk 37 and the intermediate disk 33 so as to connect the rear wheel disk 37 and the driving unit 31.

Two clutch devices 40 are respectively connected to the two front frames 11 and each clutch device 40 has a shifter 41 which has a plate 42 on the first end thereof, and the second end of the shifter 41 is a fixed end 43. A middle portion of each of the shifters 41 is pivotably connected to the front frame corresponding thereto. Each of the shifters 41 has two lugs 45 between which an insertion space 451 is defined. A hole 44 is defined between the fixed end 43 of the shifter 41 and the plate 42. The axis of the hole 44 is different from the direction that the plate 42 extends. The shifter 41 is inserted into the insertion space 451 and a bolt 452 extends through the lugs 45 and the hole 44, so that the plate 42 is located above the lugs 45 and the shifter 41 is pivotable about the bolt 452. The fixed end 43 is clamped between the two clips 431 and is fixed to the distal end of the shaft 342 that extends beyond the front wheel frame 11. The clutch device 40 is connected to the clutch disk 34 by the shifter 41 so that the clutch disk 34 is controlled to be connected to or disconnected from the intermediate disk 33.

Figure 7:
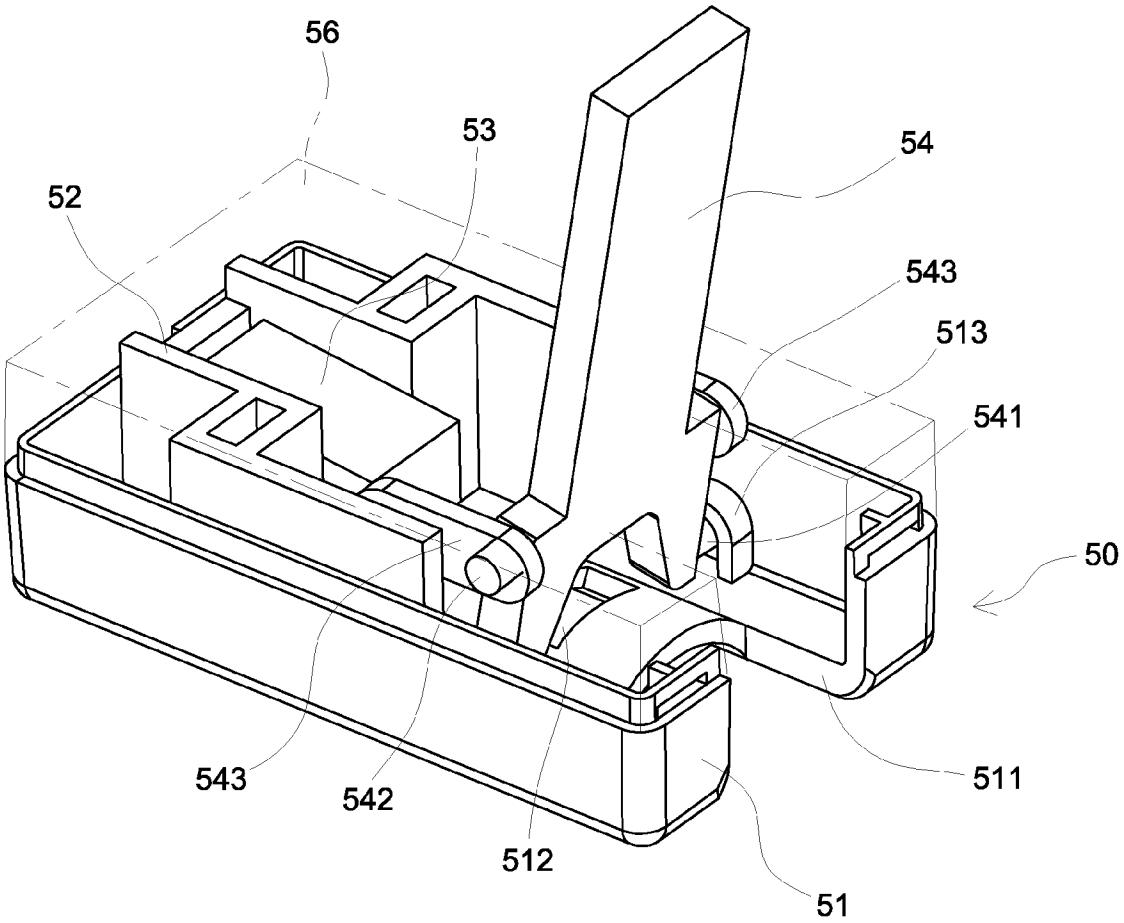
FIG. 7 shows the control unit of the wheel chair of the present invention.
Figure 8:
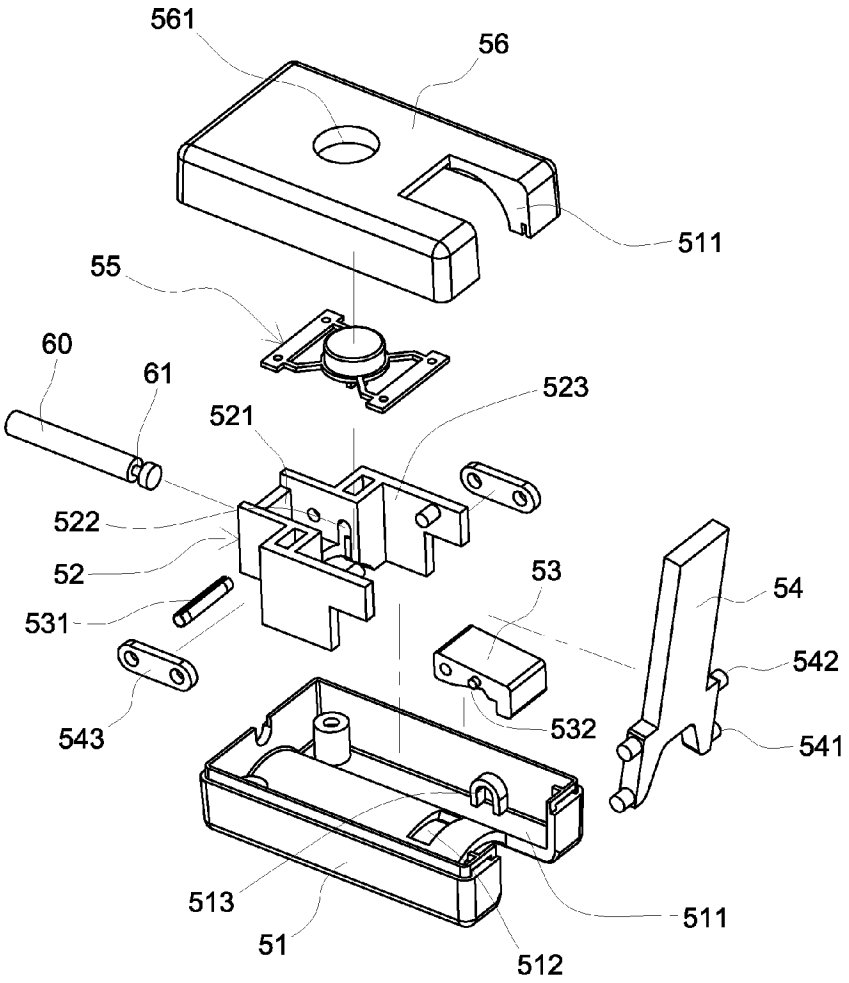
FIG. 8 is an exploded view to show the control unit of the wheel chair of the present invention.
Figure 9:
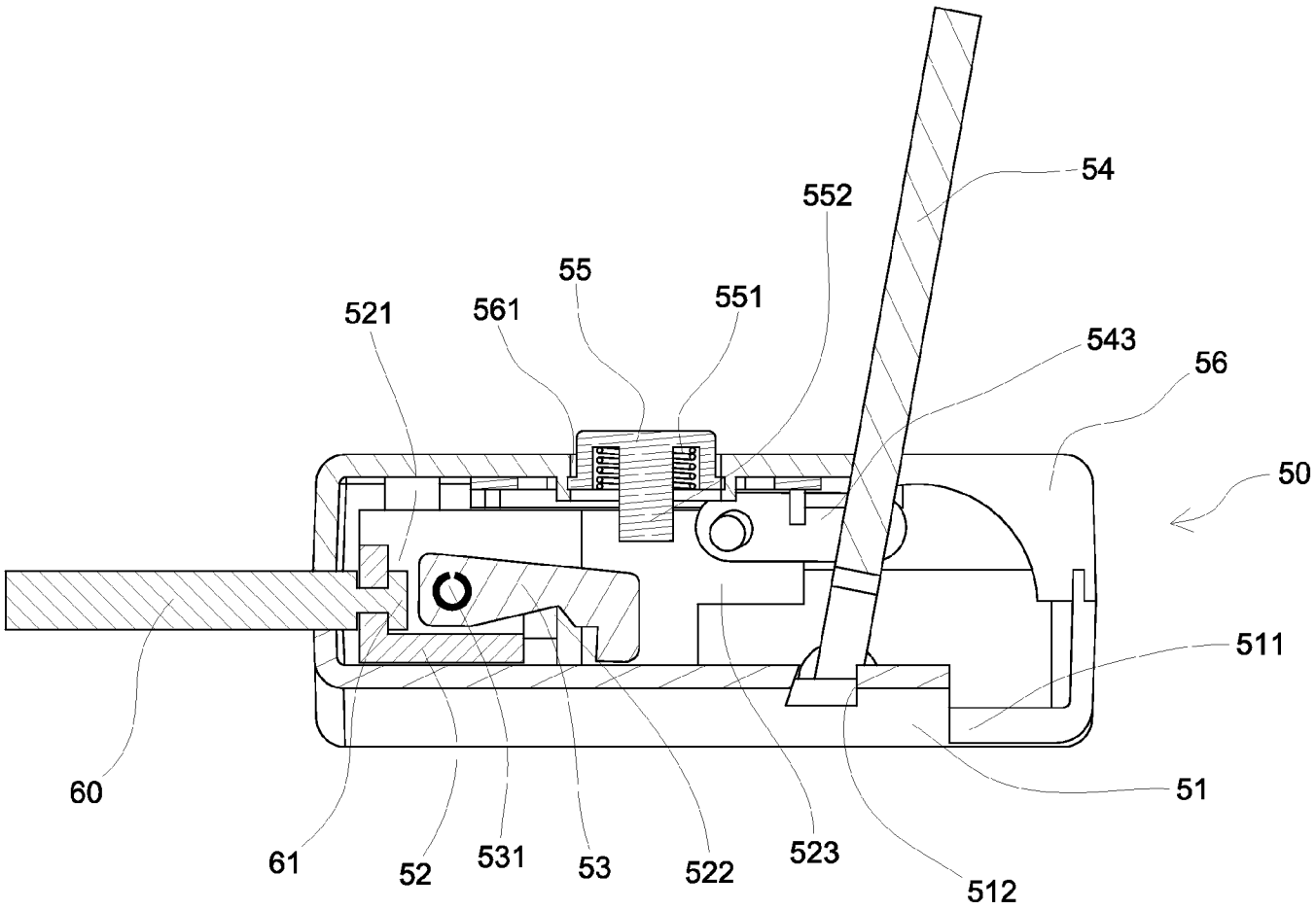
FIGS. 9 and 10 are cross sectional views to show the actions of the control unit of the wheel chair of the present invention.

As shown in FIGS. 7 to 9, two control units 50 are respectively connected to the handles 14 so as to change the positions of the clutch disks 34. Each control unit 50 has a box 51 in which a slide 52, a passive member 60 and a hooked member 53 are located.

Each of the control units 50 has a cover 56 which covers the box 51. Each of the box 51 and the cover 56 has a notch 511 defined in one end thereof, the box 51 has the restriction slot 512 which is located close to the notch 511. Two semi-circular pivotal holes 513 are respectively formed on two insides of the box 51. The slide 52 has an inner slot 521 defined in the first end thereof, and two elongate slots 522 are respectively defined in two insides of the inner slot 521. An enlarged slot 523 is defined in the second end of the slide 52. The hooked member 53 is pivotably located in the inner slot 521. The hooked member 53 has a pivot 532 extending from each of two sides thereof, and the two pivots 532 are engaged with the elongate slots 522 to restrict an upward angle that the hooked member 53 is pivoted. The hooked member 53 has an end removably located in the restriction slot 512 by a pin 531.

A push member 54 has an end pivotably connected to the box 51 and connected with the slide 52. The slide 52, the hooked member 53 and the passive member 60 are operated by pivoting the push member 54. The push member 54 has two pivotal ends 541 on two sides of one end thereof, the pivotal ends 541 are pivotably engaged with the pivotal holes 513. Two pull rods 542 extend from the two sides of the push member 54 respectively and located above the two pivotal ends 541. Two links 543 are pivotably connected between the pull rods 542 and two insides of the enlarged slot 523 of the slide 52, the push member 54 is pivoted to pull the slide 52 and the hooked member 53 by the links 543.

A button 55 is engaged with a hole 561 in the cover 56 on the box 51. The button 55 has a spring 551 connected thereto which pushes the button 55 back to its initial position after the button 55 is pushed. A contact leg 552 extends from the underside of the button 55 so as to contact the hooked member 53 when the button 55 is pushed. The button 55 is pushed to pivot the hooked member 53 to be removed from the restriction slot 512.

The passive member 60 is connected between the first end of the slide 52 and a spring 63, wherein the passive member 60 is connected to the plate 42 of the shifter 41. The second end of the slide 52 is pivotably connected to the hooked member 53. In this embodiment, the passive member 60 is a cable which has a first end 61 and a second end 62, the first end 61 of the cable is connected to the slide 52, and the second end 62 of the cable extends through the spring 63 and is connected to the plate 42 of the shifter 41. As shown in FIGS. 5, 6, 11 and 12, the passive member 60 is moved to activate the shifter 41 to shift the clutch disk 34 a distance to be engaged with the intermediate disk 33 to connect the clutch unit 32 and the driving unit 31. The spring 63 is compressed by the plate 42 to provide a force to push the shifter 41 back to its initial position.

Figure 10:
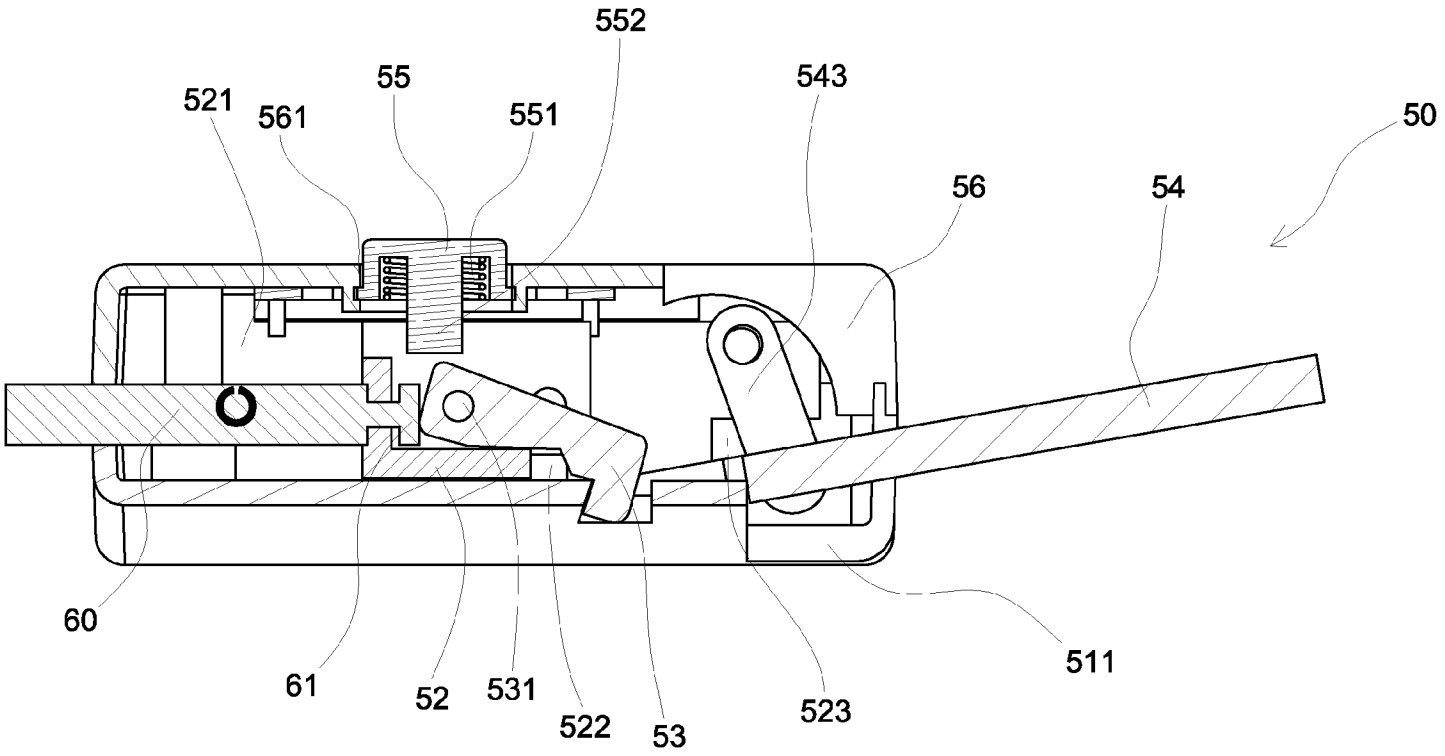
Figure 11:
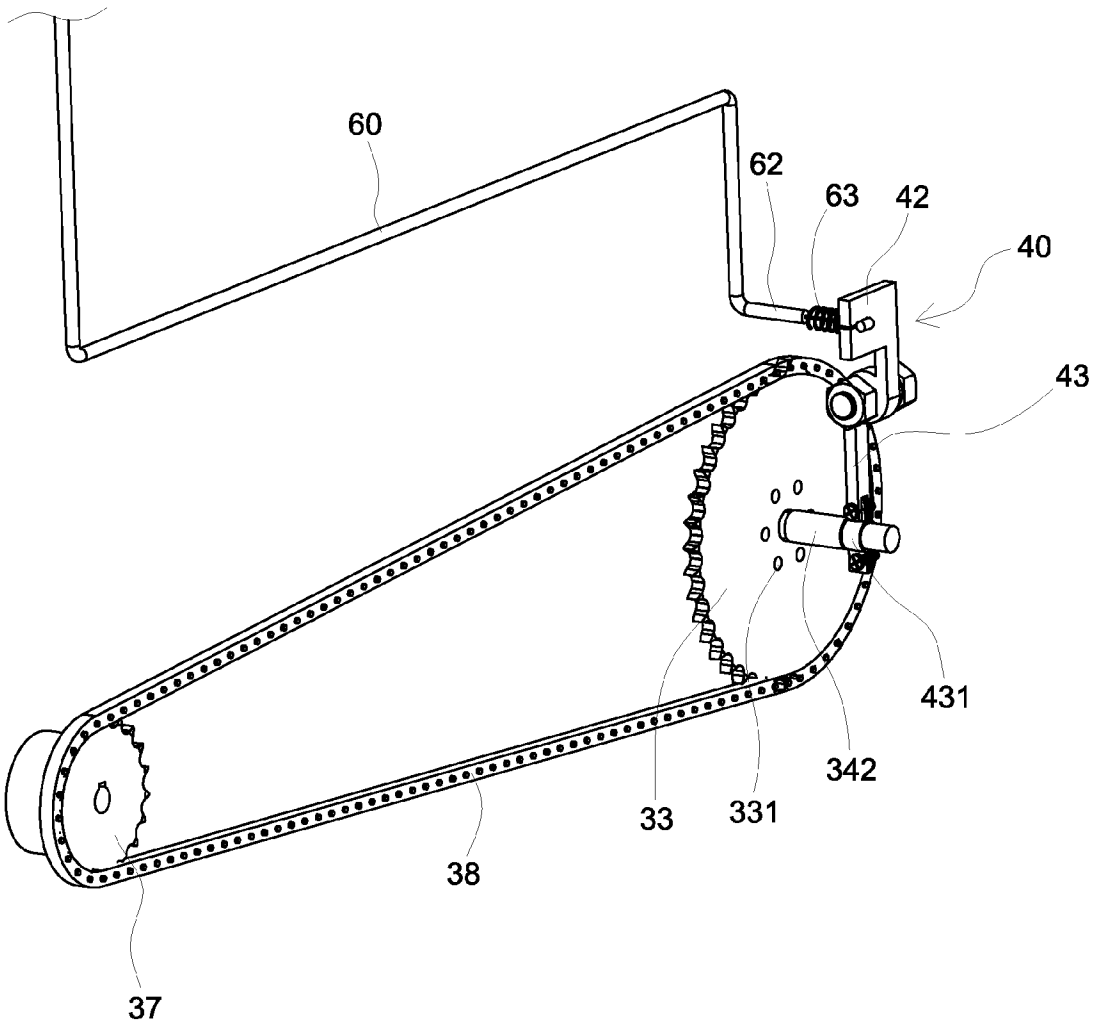
FIGS. 11 and 12 show that the actions of the clutch unit and the clutch member of the wheel chair of the present invention.
Figure 12:
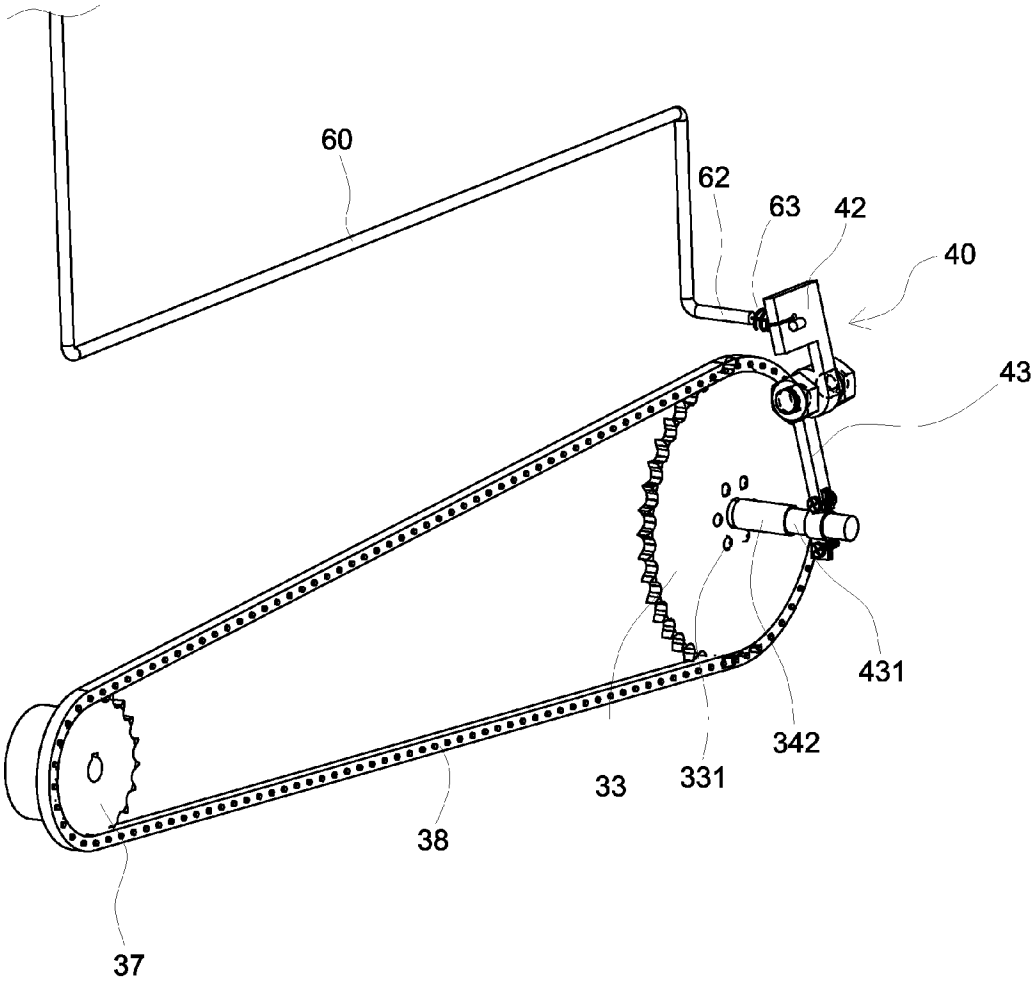

As shown in FIGS. 1, 9 and 10, if the patient cannot stand up, he or she can exercise both legs by operation of the control units 50 which can be installed to proper positions instead of on the handles 14. The push member 54 is pivoted toward the notch 511 so as to pull the link 543 which drives the slide 52 toward the push member 54, the slide 52 also co-moved with the hooked member 53. When the push member 54 is pivoted to the extreme position of the travel as shown in FIG. 10, the hooked member 53 is pivoted about the pivots 532, and one end of the hooked member 53 drops into the restriction slot 512. The passive member 60 is moved with the hooked member 53 and is pulled into the box 51. As shown in FIGS. 5, 6, 11, 12, the second end 62 is pulled to activate the shifter 41 which is pivoted about the bolt 452 to tilt the plate 42 which compresses the spring 63. The fixed end 43 is moved to shift the shaft 342 so that the second engaging portions 341 of the clutch disk 34 are engaged with the first engaging portions 331 of the intermediate disk 33 which is connected with the clutch disk 34.

Figure 13:
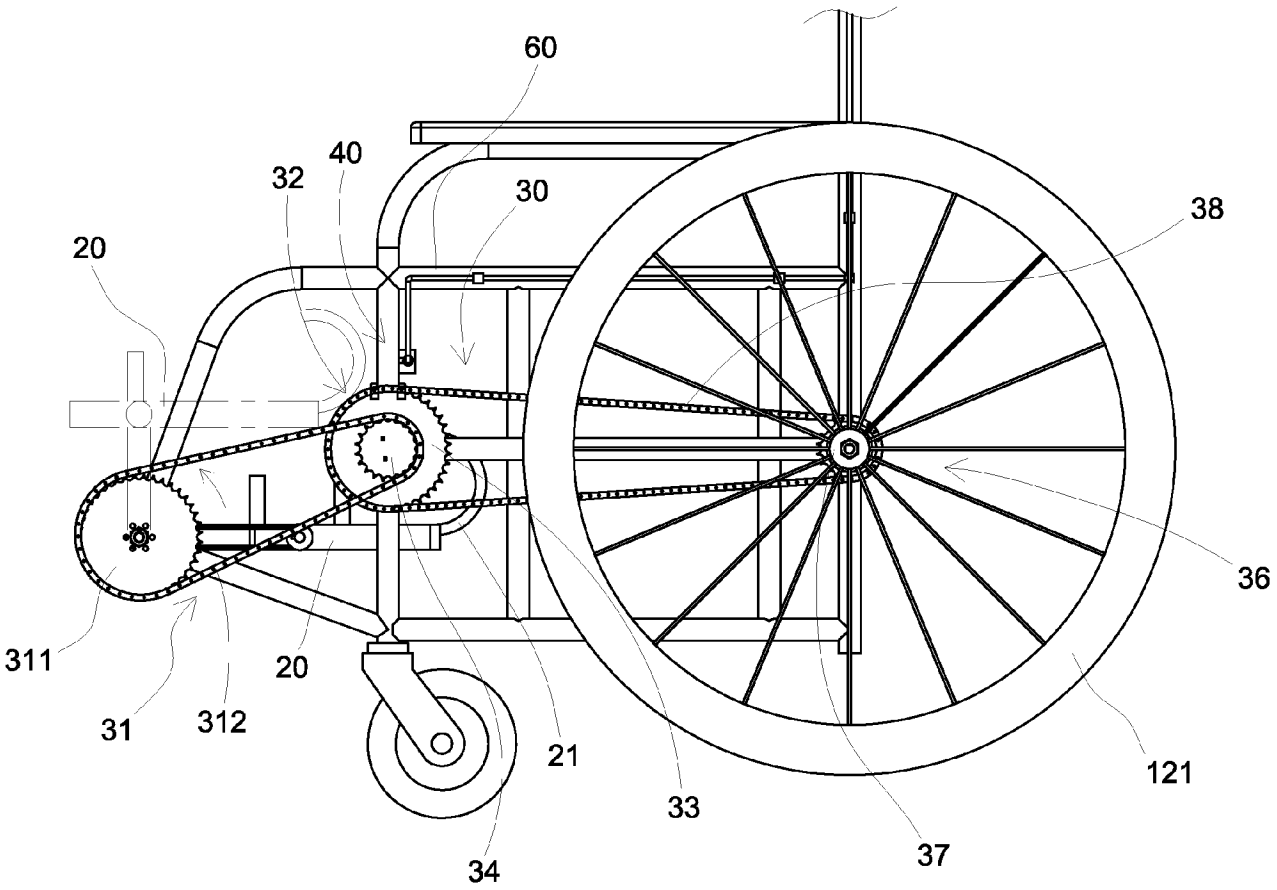
FIG. 13 is a side view to show the movement of the pedals of the wheel chair of the present invention.

As shown in FIGS. 2 and 13, each transmission device 30 is connected with the clutch disk 34 and the driving disk 311 by the clutch device 40, so that the clutch unit 32 and the rear wheel driving unit 36 drive the driving unit 31. When the wheel chair 10 is moved by the assistant, the rear wheels 121 drive the rear wheel driving units 36, the patient's legs are rotated counter clockwise about the pedals 20 and the cranks 23. The rotational speed can be adjusted according to the health condition of the patient.

When the patient wants to stop the exercise, as shown in FIGS. 9 and 10, the button 55 is pushed and the contact leg 552 contacts the hooked member 53, the hooked member 53 is pivoted about the pivots 532 to be horizontal, and the end of the hooked member 53 is removed from the restriction slot 512. Each passive member 60 is moved to its initial position by the spring 63. The first end 61 of the passive member 60 returns to its initial position and pulls the slide 52 and the hooked member 53 back to their initial positions. The shifter 41 of each clutch device 40 returns to the initial upright position, and the shaft 342 is moved to separate the intermediate disk 33 and the clutch disk 34. The clutch unit 32 is separated from the pedal 20, so that even if the rear wheels 121 are rotated, the intermediate disks 33 are rotated, but the clutch disks 34 do not rotate. The driving disks 311, the cranks 23 and the pedals 20 are not rotated.

Each transmission device 30 is driven by the rear wheel 121 and connected with the clutch disk 34 and the driving disk 311 by the clutch device 40. The clutch unit 32 and the rear wheel driving unit 36 drive the driving unit 31. The patient's legs are rotated counter clockwise about the pedals 20 and the cranks 23.

The smaller rear wheel disk 37 drives the larger intermediate disk 33, and the smaller clutch disk 34 drives the larger driving disk 311, the arrangement provides a large torque and slow speed, so that the assistant only apply limited force to easily move the wheel chair 10 in which the patient sits, the patient's legs are exercised. The rear wheels 121 rotate multiple revolutions and the cranks 23 are rotated only one revolution, so that the patient's legs are slowly rotated and exercised.

The control units 50 are operated to easily stop the rotation of the cranks 23, while the rear wheels 121 and the intermediate disks 33 of the clutch device 40 can rotate as usual.

It is noted that there are two control units 50 which respectively control the operation of the cranks 23 of the two pedals 20. In other words, the patient can choose the pedal 20 on either side of the wheel chair 10 if only one leg needs to be exercised.

All of the disks are located between the inside of the rear wheels 121 and the front wheel frames 11, by the specific arrangement, these disks do not interfere the folding action of the wheel chair 10.

The effective length of each of the cranks 23 can be adjusted to meet the requirements of different patients.

While we have shown and described the embodiment in accordance with the present invention, it should be clear to those skilled in the art that further embodiments may be made without departing from the scope of the present invention.

What is claimed is:

1. A wheel chair comprising:

two front wheel frames and two front wheels connected to the two front wheel frames, each front wheel frame having a front extension extending therefrom;

two rear wheel frames and two rear wheels connected to the two rear wheel frames;

two side frames connected between the two front wheel frames and the two rear wheel frames, two handles connected to the two rear wheel frames;

two pedals each having a connection unit on one side thereof, two cranks each having a first end and a second end, the first end of each crank connected to the connection unit corresponding thereto, the second end of each crank connected to the front extension corresponding thereto;

two transmission devices respectively connected to the two side frames and each transmission device having a driving unit, a clutch unit and a rear wheel driving unit, each of the side frames connected to the front wheel frame and connected to the second end of the crank, each of the clutch units located outside of the front wheel frame and having an intermediate disk and a clutch disk which is co-rotatably connected with the intermediate disk, each of the rear wheel driving units connected between the rear wheel and the intermediate disk;

two clutch devices respectively connected to the two front frames and each clutch device having a shifter which has a plate on a first end thereof, a second end of the shifter being a fixed end, a middle portion of each of the shifters being pivotably connected to the front frame corresponding thereto, and two control units respectively connected to the handles and each control unit having a box in which a slide, a passive member and a hooked member are located, a button located on a surface of the box and a push member connected to the box, the passive member connected between a first end of the slide and a spring, the passive member connected to the plate of the shifter, a second end of the slide pivotably connected to the hooked member, the box having a restriction slot and the hooked member having an end removably located in the restriction slot, the button being pushed to pivot the hooked member to be removed from the restriction slot, the push member having an end pivotably connected to the box and connected with the slide, wherein the slide, the hooked member and the passive member are operated by pivoting the push member, the passive member being moved to activate the shifter to shift the clutch disk to be engaged with the intermediate disk to connect the clutch unit and the driving unit, when the wheel chair moves, the rear wheels drive the rear wheel driving units such that a patient's legs on the pedals are pivoted about the cranks counter clockwise.

2. The wheel chair as claimed in claim 1, wherein each of the pedals has a curved stop extending upward from a rear end thereof, each of the connection units has a protrusion extending from the side of the pedal, a pivoting member is connected to the protrusion at an angle, the pivoting member has a slot defined in a first end thereof, the protrusion is inserted into the slot and pivotably located connected to the pivoting member, the pedal is pivoted about the protrusion and toward the front wheel frame, a second end of the pivoting member is fixed to the first end of the crank.

3. The wheel chair as claimed in claim 1, wherein each of the driving units has a driving disk and a driving chain, the driving disk is fixed to the second end of the crank, the driving chain is connected between the driving disk and the clutch disk.

4. The wheel chair as claimed in claim 1, wherein a number of teeth of the intermediate disk is 3 to 4 times of a number of teeth of the clutch disk, the intermediate disk has multiple first engaging portions on one side thereof, the clutch disk has multiple second engaging portions on one side thereof, the first engaging portions are engaged with the second engaging portions.

5. The wheel chair as claimed in claim 4, wherein the first engaging portions of each of the intermediate disks are holes and the second engaging portions of each of the clutch disks are studs.

6. The wheel chair as claimed in claim 1, wherein each of the intermediate disks has a tube extending from a center of one side thereof, each of the front wheel frames has a bearing connected thereto, the tube extends through the bearing, each of the clutch disks has a shaft extending from a center of one side thereof, the shaft extends through the tube corresponding thereto so that the clutch disk is located outside of the intermediate disk, the shaft is fixed to the fixed end of the shifter.

7. The wheel chair as claimed in claim 1, wherein each of the rear wheel driving units has a rear wheel disk which is co-axially connected to the rear wheel, a rear wheel chain is connected between the rear wheel disk and the intermediate disk so as to connect the rear wheel disk and the driving unit.

8. The wheel chair as claimed in claim 1, wherein each of the shifters has two lugs between which an insertion space is defined, a hole is defined between the fixed end of the shifter and the plate, an axis of the hole is different from a direction that the plate extends, the shifter is inserted into the insertion space and a bolt extends through the lugs and the hole, the plate is located above the lugs.

9. The wheel chair as claimed in claim 1, wherein each of the control units has a cover which covers the box, each of the box and the cover has a notch defined in one end thereof, the box has the restriction slot which is located close to the notch, two semi-circular pivotal holes are respectively formed on two inside surfaces of the box, the slide has an inner slot defined in a first end thereof, two elongate slots are respectively defined in two inside surfaces of the inner slot, the slide has an enlarged slot defined in a second end of the slide, the hooked member is pivotably located in the inner slot, the hooked member has a pivot extending from each of two sides thereof, the two pivots are engaged with the elongate slots to restrict an upward angle that the hooked member is pivoted.

10. The wheel chair as claimed in claim 9, wherein the push member has two pivotal ends on two sides of one end thereof, the pivotal ends are pivotably engaged with the pivotal holes, two pull rods extend from the two sides of the push member and are located above the two pivotal ends, two links are pivotably connected between the pull rods and two insides of the enlarged slot of the slide, the push member is pivoted to pull the slide and the hooked member by the links.

11. The wheel chair as claimed in claim 9, wherein the button has a spring connected thereto which pushes the button back to its initial position after the button is pushed, a contact leg extends from an underside of the button so as to contact the hooked member when the button is pushed.

12. The wheel chair as claimed in claim 1, wherein the passive member is a cable which has a first end and a second end, the first end of the cable is connected to the slide, the second end of the cable extends through the spring, the second end of the cable is connected to the plate of the shifter, the spring is compressed by the plate to provide a force to push the shifter back to its initial position.

* * * * *